US012601117B2

(12) United States Patent
Miyauchi

(10) Patent No.: US 12,601,117 B2
(45) Date of Patent: Apr. 14, 2026

(54) METHOD OF CONTROLLING SHEET MANUFACTURING APPARATUS

(71) Applicant: SEIKO EPSON CORPORATION, Tokyo (JP)

(72) Inventor: Keisuke Miyauchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 126 days.

(21) Appl. No.: 18/774,990

(22) Filed: Jul. 17, 2024

(65) Prior Publication Data

US 2025/0027272 A1 Jan. 23, 2025

(30) Foreign Application Priority Data

Jul. 19, 2023 (JP) ..... 2023-117356

(51) Int. Cl.
*D21H 25/04* (2006.01)
*D21G 9/00* (2006.01)

(52) U.S. Cl.
CPC ..... *D21G 9/0036* (2013.01); *D21G 9/0027* (2013.01)

(58) Field of Classification Search
CPC ..... D21G 9/0036; D21G 9/0027; D21H 25/04
USPC ..... 162/252
See application file for complete search history.

(56) References Cited

U.S. PATENT DOCUMENTS

2007/0267160 A1* 11/2007 Sundqvist ..... D21G 9/0036 162/263
2007/0285456 A1* 12/2007 Takasu ..... B41J 2/04588 347/19
2014/0290886 A1 10/2014 Nagai et al.
2018/0119359 A1* 5/2018 Gorden ..... D21H 21/146
2022/0196270 A1* 6/2022 Goudy ..... F24F 6/12

FOREIGN PATENT DOCUMENTS

JP 2014-208923 A 11/2014

* cited by examiner

*Primary Examiner* — Jacob T Minskey
(74) *Attorney, Agent, or Firm* — Spencer Fane LLP

(57) ABSTRACT

A sheet manufacturing apparatus includes a transport portion that transports a web formed of a material containing fibers, a humidifier that humidifies the web with air mixed with water supplied from a tank, a heating roller that is positioned downstream of the humidifier and that forms a sheet from the web, a moisture meter that is positioned between the humidifier and the heating roller and that measures a moisture amount in the web, a thermometer that measures a temperature of the water in the tank, and a hygrometer that measures humidity. A method of controlling the sheet manufacturing apparatus includes controlling, as a first mode, drive of the humidifier, based on a measurement result by at least one of the thermometer and the hygrometer until when a leading end of the web reaches the moisture meter, and controlling, as a second mode, the drive of the humidifier, based on a measurement result by the moisture meter after execution of the first mode.

4 Claims, 3 Drawing Sheets

FIG. 3

| | CONDITION 1 | CONDITION 2 | CONDITION 3 | CONDITION 4 | CONDITION 5 | CONDITION 6 | CONDITION 7 |
|---|---|---|---|---|---|---|---|
| TEMPERATURE OF WATER (°C) | 12 OR LESS | 32 OR MORE | 17.5 OR LESS | 17.5 OR LESS | 27.5 OR MORE | 27.5 OR MORE | OTHER THAN LEFT VALUES |
| HUMIDITY (%RH) | — | — | 35 OR LESS | 60 OR MORE | 35 OR LESS | 60 OR MORE | OTHER THAN LEFT VALUES |
| DUTY RATIO (%) | 100 | 40 | 100 | 60 | 80 | 40 | 65 |

METHOD OF CONTROLLING SHEET MANUFACTURING APPARATUS

The present application is based on, and claims priority from JP Application Serial Number 2023-117356, filed Jul. 19, 2023, the disclosure of which is hereby incorporated by reference herein in its entirety.

BACKGROUND

1. Technical Field

The present disclosure relates to a method of controlling a sheet manufacturing apparatus.

2. Related Art

JP-A-2014-208923 discloses a sheet manufacturing apparatus including a measurement unit that acquires moisture amount information of a defibrated material and a moisture amount adjustment unit that adjusts a moisture amount of the defibrated material, based on the moisture amount information. According to JP-A-2014-208923, the moisture amount information of the transported defibrated material is acquired by the measurement unit, and the moisture amount of the defibrated material is adjusted by the moisture amount adjustment unit positioned downstream of the measurement unit in a transport direction, based on the acquired moisture amount information.

In the sheet manufacturing apparatus described in JP-A-2014-208923, the result of adjusting the moisture amount of the defibrated material by the moisture amount adjustment unit is not taken. In other words, the sheet manufacturing apparatus cannot perform a feedback-control on the moisture amount of the defibrated material. In order to perform the feedback-control on the moisture amount of the defibrated material, a configuration is conceivable in which the measurement unit is disposed downstream of the moisture amount adjustment unit in the transport direction of the defibrated material. With the use of the configuration above, it is possible to control the moisture amount adjustment unit, based on the moisture amount information acquired by the measurement unit. However, in the configuration in which the measurement unit is disposed downstream of the moisture amount adjustment unit in the transport direction of the defibrated material, it is not possible to perform the feedback-control in a period from when transport of the defibrated material is started to when a leading end of the defibrated material reaches the measurement unit. That is, in the sheet manufacturing apparatus in which the measurement unit is disposed downstream of the moisture amount adjustment unit in the transport direction of the defibrated material, it is difficult to control the moisture amount adjustment unit in a period from when the transport of the defibrated material is started to when the leading end of the defibrated material reaches the measurement unit.

SUMMARY

A control method of a sheet manufacturing apparatus is a method of controlling a sheet manufacturing apparatus that manufactures a sheet from a material containing fibers. The sheet manufacturing apparatus includes a deposition portion that forms a web from the material by depositing the material, a transport portion that includes a transport belt which transports the web in a state that the web is supported, a humidifier that humidifies the web by discharging air mixed with water supplied from a tank which stores the water, a heating roller that is positioned downstream of the humidifier in a transport direction of the web and that heats the web to form the sheet from the web, a moisture meter that is positioned between the humidifier and the heating roller and that measures a moisture amount contained in the web, a thermometer that measures a temperature of the water stored in the tank, and a hygrometer that measures humidity outside the sheet manufacturing apparatus. The control method includes controlling, as a first mode, drive of the humidifier, based on at least one of a measurement result of the temperature of the water by the thermometer and a measurement result of the humidity by the hygrometer until when a leading end of the web reaches the moisture meter, and controlling, as a second mode, the drive of the humidifier, based on a measurement result of the moisture amount by the moisture meter after execution of the first mode.

BRIEF DESCRIPTION OF THE DRAWINGS

FIG. 3 is a table for deriving a duty ratio.

DESCRIPTION OF EMBODIMENTS

Figure 1:
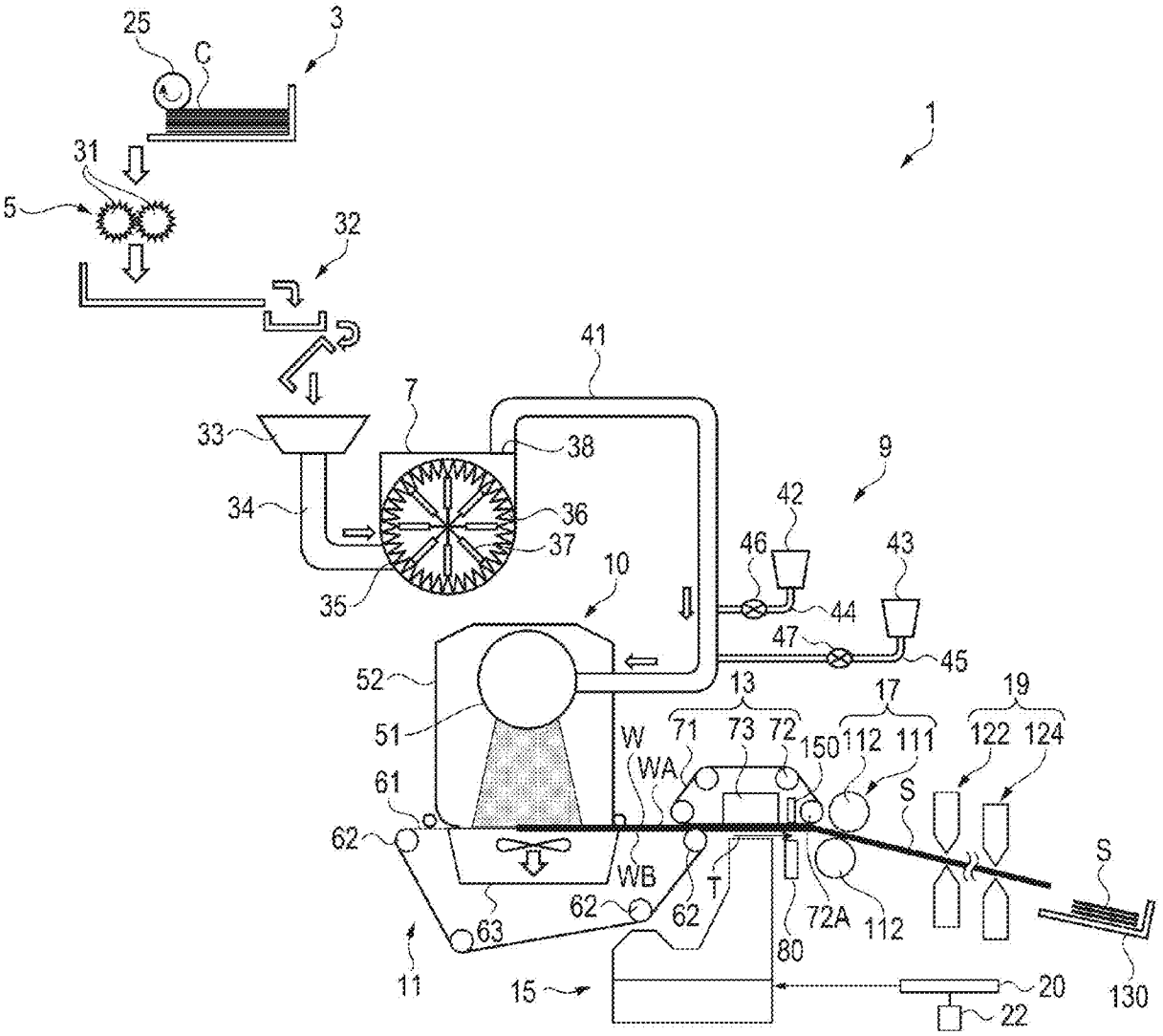
FIG. 1 is a schematic diagram of a sheet manufacturing apparatus illustrating a configuration thereof.

As illustrated in FIG. 1, a sheet manufacturing apparatus 1 includes a supply portion 3, a crusher 5, a defibrator 7, a mixer 9, a deposition portion 10, a web forming portion 11, a web transport portion 13, a humidifier 15, a sheet forming portion 17, and a cutting portion 19. The sheet manufacturing apparatus 1 manufactures a sheet S from a raw material C. The raw material C changes to a form of a web W and to a form of the sheet S in this order through various processes. The various processes of forming the sheet S from the raw material C are mainly executed by the above-described processing portions. In other words, each of the supply portion 3, the crusher 5, the defibrator 7, the mixer 9, the deposition portion 10, the web forming portion 11, the web transport portion 13, the humidifier 15, the sheet forming portion 17, and the cutting portion 19 is a processing portion. The web transport portion 13 is an example of a transport portion. The humidifier 15 is an example of a humidifier.

Note that the processing portions are not limited thereto. Other processing portions may be added to the processing portions above, or some of these processing portions may be combined or omitted. In a path of processes in which the sheet S is formed from the raw material C, a direction toward a post-process is referred to as downstream, and a direction toward a pre-process is referred to as upstream. That is, the raw material C changes to the web W and the sheet S in this order in the path of processes from upstream to downstream. Note that, in each of transport paths of the web W and the sheet S in the path of processes, a transport direction is referred to as downstream, and a direction opposite to the transport direction is referred to as upstream. The web W and the sheet S are each transported from upstream to downstream in the transport path.

The sheet manufacturing apparatus 1 also includes a controller 20 and a hygrometer 22. The controller 20 is a controller that integrally controls the operation of the sheet manufacturing apparatus 1. The controller 20 controls an operation of each processing portion of the sheet manufacturing apparatus 1. The hygrometer 22 measures the humidity of the environment in which the sheet manufacturing apparatus 1 is disposed. The hygrometer 22 may be disposed inside or outside a housing (not illustrated) of the sheet manufacturing apparatus 1. The hygrometer 22 is communicably coupled to the controller 20. A measurement result of the humidity by the hygrometer 22 is outputted to the controller 20.

The controller 20 includes a processor and a memory. The processor is constituted of a central processing unit (CPU), a micro processing unit (MPU), or the like. The memory includes a random access memory (RAM), a read only memory (ROM), and the like. The RAM functions as a work area of the processor. The RAM is used to temporarily store various control programs, various types of data, and the like. The ROM stores a control program for controlling the operation of the sheet manufacturing apparatus 1, various types of setting information, and the like.

The processor functions as various functional units by executing the control program stored in the memory. The functions performed by the processor include a function of controlling the operation of each processing portion of the sheet manufacturing apparatus 1. The functional units of the processor include a supply controller, a crushing controller, a defibration controller, a mixing controller, a deposition controller, a web forming controller, a web transport controller, a humidification controller, a sheet forming controller, and a cutting controller. The supply controller controls the operation of the supply portion 3. The crushing controller controls the operation of the crusher 5. The defibration controller controls the operation of the defibrator 7. The mixing controller controls the operation of the mixer 9. The deposition controller controls the operation of the deposition portion 10. The web forming controller controls the operation of the web forming portion 11. The web transport controller controls the operation of the web transport portion 13. The humidification controller controls the operation of the humidifier 15. The sheet forming controller controls the operation of the sheet forming portion 17. The cutting controller controls the operation of the cutting portion 19.

The supply portion 3 supplies the raw material C to the crusher 5. The supply portion 3 includes an automatic feed mechanism 25. The supply portion 3 automatically feeds the raw material C to the crusher 5 with the automatic feed mechanism 25. The raw material C includes various types of fibers or various types of fiber materials. The various types of fibers are not particularly limited, and a wide variety of fibers can be used. Examples of the fibers include natural fibers (animal fibers and plant fibers) and chemical fibers (organic fibers, inorganic fibers, and organic-inorganic composite fibers). More specifically, the fibers made of cellulose, silk, wool, cotton, hemp, kenaf, flax, ramie, jute, abaca, sisal, conifer, broadleaf tree, and the like are exemplified. The fibers above may be used alone, may be appropriately mixed and used, or may be used as regenerated fibers subjected to purification or the like.

Examples of the fiber material include pulp, used paper, used cloth, and the like. Further, the fiber may be subjected to various surface treatments. The material of the fiber may be a pure substance or may be a material containing a plurality of components such as impurities and other components. Further, a defibrated material obtained by defibrating used paper, pulp sheets, or the like in a dry process may be used as the fiber. A length of the fiber is not particularly limited, but a length along a longitudinal direction of one independent fiber is 1 μm or more and 5 mm or less, preferably 2 μm or more and 3 mm or less, and more preferably 3 μm or more and 2 mm or less.

In the sheet manufacturing apparatus 1, moisture is applied to the web W in the humidifier 15 described later. Therefore, when fibers capable of forming hydrogen bonds between fibrils are used as the fibers contained in the web W, a mechanical strength of the formed sheet S can be increased. Examples of such fibers include cellulose. In the following description, applying moisture to the web W by the humidifier 15 is also referred to as humidification. The content of the fibers in the sheet S is, for example, 50 mass % or more and 99.9 mass % or less, preferably 60 mass % or more and 99 mass % or less, and more preferably 70 mass % or more and 99 mass % or less. As will be described later, such content can be obtained by performing predetermined blending when a mixture is formed in the mixer 9.

The crusher 5 cuts the raw material C supplied by the supply portion 3 into small pieces in a dry process in a gas such as air. The small piece is a square in shape and a few cm in size, for example. The crusher 5 includes a crushing blade 31. The crusher 5 can cut the raw material C with the crushing blade 31. As the crusher 5, for example, a shredder can be used. The small pieces of the raw material C cut by the crusher 5 are transported to a fixed-quantity supply portion 32. The fixed-quantity supply portion 32 measures the small pieces of the raw material C and supplies a fixed quantity thereof to a hopper 33. The fixed-quantity supply portion 32 is, for example, a vibration feeder. The small pieces of the raw material C supplied to the hopper 33 are transported to an introduction port 35 of the defibrator 7 through a pipe 34. The introduction port 35 is a receiving port for introducing the small pieces of the raw material C into the defibrator 7.

The defibrator 7 defibrates the small pieces of the raw material C in a dry process. The defibrator 7 includes a stator 36 and a rotor 37. The stator 36 has a cylindrical shape. The rotor 37 rotates along a cylindrical inner side surface of the stator 36. The stator 36 and the rotor 37 constitute a so-called impeller mill. The small pieces of the raw material C introduced from the introduction port 35 rotate while being pinched between the stator 36 and the rotor 37 and are defibrated by a shearing force generated therebetween. Entangled fibers are untangled by the defibrator 7, and a defibrated material is generated.

Furthermore, the defibrator 7 can generate airflow by the rotation of the rotor 37. The small pieces of the raw material C are sucked into the defibrator 7 from the introduction port 35 by the airflow generated by the rotation of the rotor 37. In addition, the defibrated material defibrated from the small pieces of the raw material C is discharged from a discharge port 38 to the inside of a pipe 41 by the airflow generated by the rotation of the rotor 37. The defibrated material defibrated by the defibrator 7 is transported from the discharge port 38 to the deposition portion 10 through the pipe 41. The airflow for transporting the defibrated material from the defibrator 7 to the deposition portion 10 is not limited to the airflow generated by the defibrator 7. By adding an airflow generation device such as a blower (not illustrated), airflow generated by the airflow generation device can also be used.

One end of the pipe 41 communicates with the inside of the defibrator 7. The other end of the pipe 41 on a side opposite to the defibrator 7 communicates with the inside of the deposition portion 10. The mixer 9 is disposed between the defibrator 7 and the deposition portion 10. The mixer 9 is coupled to the pipe 41. The mixer 9 mixes a binder and the like with the defibrated material in a gas such as air. The mixer 9 includes a hopper 42, a hopper 43, a supply pipe 44, a supply pipe 45, a valve 46, and a valve 47. Each of the hopper 42 and the hopper 43 may include a screw feeder, a disk feeder, or the like (not illustrated).

The hopper 42 communicates with the inside of the pipe 41 through the supply pipe 44. The supply pipe 44 is provided with the valve 46. The valve 46 is provided between the hopper 42 and the pipe 41. The hopper 42 supplies the binder to the inside of the supply pipe 44. The binder supplied to the supply pipe 44 is supplied to the inside of the pipe 41. The valve 46 adjusts the weight of the binder supplied from the hopper 42 to the pipe 41. Thus, a mixing ratio of the defibrated material and the binder is adjusted. The hopper 43 communicates with the inside of the pipe 41 through the supply pipe 45. The supply pipe 45 is provided with the valve 47. The valve 47 is provided between the hopper 43 and the pipe 41. The hopper 43 supplies an additive other than the binder to the inside of the supply pipe 45. The additive supplied to the supply pipe 45 is supplied to the inside of the pipe 41. The valve 47 adjusts the weight of the additive supplied from the hopper 43 to the pipe 41. Thus, a mixing ratio of the defibrated material and the additive is adjusted. A mixture of defibrated material, binder, and additive is transported to the deposition portion 10 through the pipe 41.

The binder is, for example, starch or dextrin. The starch is a polymer in which a plurality of a-glucose molecules are polymerized by glycosidic bonds. The starch may be linear or may include branching. The starch derived from various plants can be used. Examples of raw materials of the starch include cereals such as corn, wheat, and rice; beans such as broad beans, mung beans, and adzuki beans; potatoes such as potatoes, sweet potatoes, and tapioca; wild grasses such as dogtooth violet, bracken, and kudzu; and palms such as sago palms.

Further, processed starch or modified starch may be used as the starch. Examples of the processed starch include acetylated distarch adipate, acetylated starch, oxidized starch, starch sodium octenyl succinate, hydroxypropyl starch, hydroxypropyl distarch phosphate, phosphorylated starch, phosphated distarch phosphate, urea phosphate esterified starch, sodium starch glycolate, and high amylose corn starch. Furthermore, a substance obtained by processing or modifying starch can be suitably used for dextrin as the modified starch.

By using starch or dextrin as the binder in the sheet manufacturing apparatus 1, a sufficient strength can be imparted to the manufactured sheet S. This is because at least one of the gelatinization of the binder and the hydrogen bonding between the fibrils of the fibers occurs by pressing and heating the web W by the sheet forming portion 17, after adding moisture to the web W by the humidifier 15 to be described later. Meanwhile, when the sheet S can have a sufficient strength only by the hydrogen bonding between the fibrils of the fibers, the addition of the binder may be omitted. When the addition of the binder is omitted, the hopper 42, the supply pipe 44, and the valve 46 can be omitted from the sheet manufacturing apparatus 1.

The content of starch or dextrin in the sheet S is, for example, 0.1 mass % or more and 50 mass % or less. Preferably, the content of the starch or dextrin in the sheet S is 1 mass % or more and 40 mass % or less. More preferably, the content of the starch or dextrin in the sheet S is 1 mass % or more and 30 mass % or less. Such content can be obtained by adjusting the valve 46 of the mixer 9. The additive supplied from the hopper 43 to the pipe 41 may include a coloring agent for coloring the fibers, an aggregation inhibitor, a flame retardant, and the like. The aggregation inhibitor suppresses aggregation of the fibers and aggregation of the binder. The flame retardant makes the fiber and the like less flammable. Note that the additive is not an essential component. When the additive is omitted, the hopper 43, the supply pipe 45, and the valve 47 can be omitted.

The defibrated material in which the binder and the additive are mixed is transported to the deposition portion 10 through the pipe 41. In the downstream process of the mixer 9, the defibrated material in which the binder and the additive are mixed is also simply referred to as the defibrated material. The deposition portion 10 includes a drum 51, a housing 52, and the web forming portion 11. The housing 52 accommodates the drum 51. The defibrated material in which the binder and the additive are mixed is introduced into the drum 51 through the pipe 41. The drum 51 untangles entangled fibers and the like. The drum 51 includes a rotatable cylindrical sieve. The defibrated material is introduced into the cylindrical sieve.

The defibrated material introduced into the drum 51 is untangled by the rotating cylindrical sieve. The cylindrical sieve is constituted by a net. Fibers and particles smaller than the size of the openings of the net pass through the openings of the net and are discharged to the outside of the drum 51. The fibers and particles pass through the openings of the cylindrical net rotated by a motor (not illustrated) and are deposited on the web forming portion 11 while being dispersed in a gas such as air. As a result, the drum 51 can uniformly deposit the defibrated material on the web forming portion 11.

A direction from the drum 51 toward the web forming portion 11 is a downward direction of the sheet manufacturing apparatus 1. Conversely, a direction from the web forming portion 11 toward the drum 51 is an upward direction of the sheet manufacturing apparatus 1. The web forming portion 11 is positioned under the deposition portion 10. The drum 51 is positioned above the web forming portion 11. In addition, the "sieve" of the drum 51 need not have a function of sorting a specific object. That is, the "sieve" used as the drum 51 means an object provided with a net, and the drum 51 may drop all the defibrated materials introduced into the drum 51.

The web forming portion 11 includes a first mesh belt 61, a plurality of tension rollers 62, and a first suction mechanism 63. The web forming portion 11 forms the web W by depositing the defibrated material falling from the drum 51. The defibrated material that has passed through the drum 51 is deposited on the first mesh belt 61. The first mesh belt 61 is formed of a mesh-like material. The first mesh belt 61 is stretched by the tension roller 62, and the defibrated material hardly passes through the first mesh belt 61, and air easily passes through the first mesh belt 61. The first mesh belt 61 is a so-called endless belt and rotates clockwise in FIG. 1 with the tension roller 62 being rotated by a motor (not illustrated). The defibrated material continuously falls from the drum 51 and is deposited on the first mesh belt 61 which is rotationally driven, and thus the web W is formed on the first mesh belt 61.

The first suction mechanism 63 is provided under the first mesh belt 61. The first suction mechanism 63 can generate a downward airflow. The defibrated material dispersed in the air by the drum 51 can be suctioned onto the first mesh belt 61 by the first suction mechanism 63. Further, the discharge speed of the defibrated material from the deposition portion 10 can be increased by the first suction mechanism 63. Furthermore, a downflow can be formed in a falling path of the defibrated material by the first suction mechanism 63, and it is possible to prevent the fibers, the binder, and the like from being entangled with each other during falling.

As described above, the deposition portion 10 can form the web W by depositing the mixture containing the fiber using the airflow. By passing through the deposition portion 10, the binder or the like is further mixed with the fiber, and the web W in a soft and swollen state containing a large amount of air is formed. The web transport portion 13 is positioned downstream of the web forming portion 11. The web transport portion 13 is disposed downstream of the web W on the first mesh belt 61. The web W formed on the first mesh belt 61 is transferred from the first mesh belt 61 to the web transport portion 13. The web transport portion 13 transports the web W on the first mesh belt 61 in a transport direction T. Specifically, the web transport portion 13 peels off the web W from the first mesh belt 61 and transports the web W toward the sheet forming portion 17.

The sheet forming portion 17 is positioned downstream of the web transport portion 13 in the transport path of the web W. The web W is transported from the web transport portion 13 toward the sheet forming portion 17. The sheet forming portion 17 includes a pressing and heating portion 111. A heating roller, a heat press molding machine, or the like can be applied as the pressing and heating portion 111, for example. In the present embodiment, a pair of heating rollers 112 is applied to the pressing and heating portion 111. The pair of heating rollers 112 is also simply referred to as the heating roller 112. The web W is in a state before being pressed or heated in the sheet forming portion 17.

The sheet forming portion 17 presses and heats the web W at the same time. When the web W humidified by the humidifier 15 is heated and pressed in the sheet forming portion 17, the fiber density increases. This is because moisture contained in the web W evaporates after the temperature rises, and the thickness of the web W decreases. The temperature of the moisture and the binder contained in the web W is increased by heat, and the fiber density is increased by pressure. As a result, the binder is gelatinized, and the plurality of fibers are bound to each other with the binder gelatinized by the evaporation of moisture. Further, because the moisture is evaporated by heat, and the fiber density is increased by pressure, the plurality of fibers are bonded by hydrogen bonding between fibrils. As a result, it is possible to form the sheet S having a high mechanical strength and a preferable quality.

The heating of the web W by the pair of heating rollers 112 is preferably performed such that the temperature of the web W is 60° C. or more and 100° C. or less. The pressure applied to the web W by the pair of heating rollers 112 is preferably 0.1 MPa or more and 15 MPa or less, more preferably 0.2 MPa or more and 10 MPa or less, and still more preferably 0.4 MPa or more and 8 MPa or less. When the pressure is in a range described above, deterioration of the fiber can be reduced, and the sheet S with a preferable strength can be manufactured again by using defibrated material obtained by defibrating the manufactured sheet S as a raw material.

The sheet forming portion 17 may be configured to perform at least one of heating and pressing. The sheet forming portion 17 can form the sheet S by performing at least one of heating and pressing. The sheet forming portion 17 can bind the plurality of fibers to each other with the binder and form the sheet S compressed in a sheet shape by performing at least one of heating and pressing.

The cutting portion 19 is positioned downstream of the sheet forming portion 17 in the transport path of the web W. The sheet S that is formed in the sheet forming portion 17 has a continuous sheet shape. As illustrated in FIG. 1, the cutting portion 19 cuts the sheet S having the continuous sheet shape. The cutting portion 19 includes a first cutting portion 122 and a second cutting portion 124. The first cutting portion 122 cuts the sheet S in a width direction which is a direction intersecting with the transport direction T of the sheet S. The second cutting portion 124 cuts the sheet S in a length direction which is a direction parallel to the transport direction T. After the first cutting portion 122 cuts the sheet S in the width direction, the second cutting portion 124 cuts the sheet S in the length direction. The sheet S of a cut sheet shape having a predetermined size is manufactured by the cutting portion 19. The sheet S in the cut sheet shape, which has been cut, is discharged to a discharge receiving portion 130.

Figure 2:
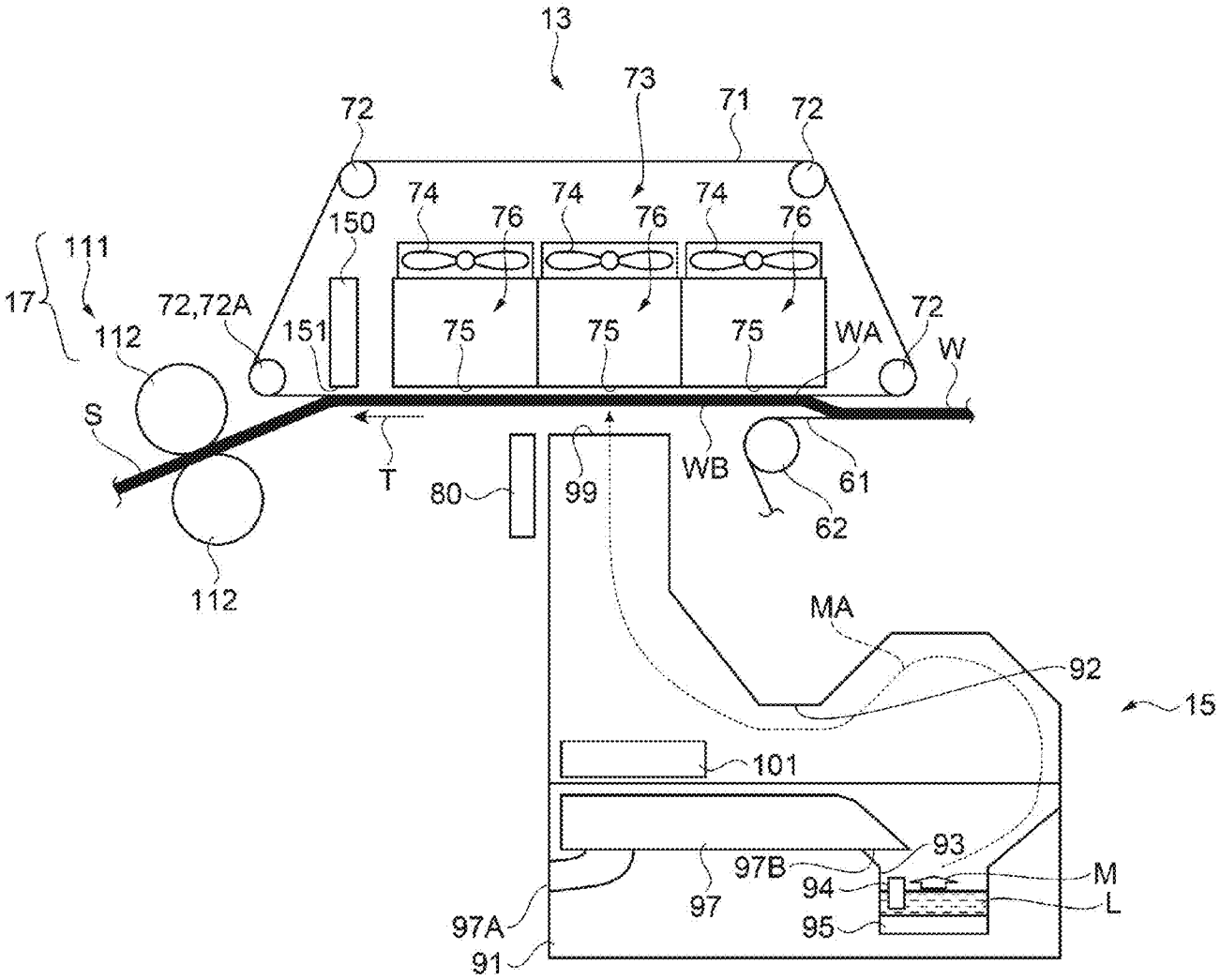
FIG. 2 is a schematic diagram of a web transport portion, a humidifier, and a sheet forming portion.

As illustrated in FIG. 2, the web transport portion 13 includes a second mesh belt 71, a plurality of rollers 72, and a second suction mechanism 73. The second mesh belt 71 is an example of a transport belt. Note that viewing directions of the sheet manufacturing apparatus 1 in FIG. 1 and FIG. 2 differ from each other. The viewing directions in FIG. 1 and FIG. 2 are opposite to each other. This is clear from the fact that the direction of the transport direction T in FIG. 1 and the direction of the transport direction T in FIG. 2 are opposite to each other. The second mesh belt 71 is formed of a mesh-like material. As illustrated in FIG. 2, the second mesh belt 71 is stretched by the plurality of rollers 72, and humidified air MA described later can pass through the second mesh belt 71. The second mesh belt 71 is an endless belt, and rotates clockwise in FIG. 2 with the roller 72 being rotated by a motor (not illustrated). The web W is transported in the transport direction T by the second mesh belt 71 which is rotationally driven.

The second suction mechanism 73 is disposed at a position facing the web W from above with the second mesh belt 71 interposed therebetween. The second suction mechanism 73 includes a plurality of suction fans 74. The second suction mechanism 73 generates an upward airflow through the second mesh belt 71 in contact with the web W, by a suction force of the plurality of suction fans 74. The direction of the airflow is also a thickness direction of the web W. The web W is sucked from above through the second mesh belt 71 by the airflow, and the web W can be held under the second mesh belt 71. A direction from the second suction mechanism 73 toward the web W is the downward direction of the sheet manufacturing apparatus 1. Conversely, a direction from the web W toward the second suction mechanism 73 is the upward direction of the sheet manufacturing apparatus 1. The transport path of the web W is positioned under the second suction mechanism 73. The second suction mechanism 73 is positioned on the transport path of the web W.

The second suction mechanism 73 has a plurality of suction ports 75 to suck the humidified air MA described later. The second suction mechanism 73 has suction ducts 76 coupled to the respective plurality of suction ports 75. The suction duct 76 is defined by a wall forming the suction port 75. A suction amount for the web W can be stabilized by the suction ducts 76 coupled to the respective plurality of suction ports 75. By the web transport portion 13, the web W can be peeled off from the first mesh belt 61, transferred to the second mesh belt 71, and transported in the transport direction T.

One surface WA, which is an upper surface of the web W, comes into contact with the second mesh belt 71. The other surface WB, which is a lower surface of the web W, is not in contact with the second mesh belt 71. That is, the one surface WA of the web W is not in contact with the first mesh belt 61, but is in contact with the second mesh belt 71. The other surface WB of the web W is in contact with the first mesh belt 61, but is not in contact with the second mesh belt 71. When the web W is transferred from the first mesh belt 61 to the second mesh belt 71, a state that the other surface WB is in contact with the first mesh belt 61 changes to a state that the one surface WA is in contact with the second mesh belt 71.

Of surfaces of the second mesh belt 71, a surface in contact with the one surface WA of the web W is referred to as one surface. The surface of the second mesh belt 71 that is not contact with the web W is referred to as the other surface. The one surface of the second mesh belt 71 is an outer circumferential surface of the endless second mesh belt 71. The other surface of the second mesh belt 71 is an inner circumferential surface of the endless second mesh belt 71. When the one surface of the second mesh belt 71 faces downward, the web W is sucked by the second suction mechanism 73 and is attracted to the one surface of the second mesh belt 71. That is, the one surface of the second mesh belt 71 facing downward can hold the web W against gravity. Such second mesh belt 71 is also referred to as a back surface transport belt.

The web W is transported in the transport direction T in a state that the one surface WA is in contact with the one surface of the second mesh belt 71 under the second mesh belt 71. At this time, the second suction mechanism 73 can stably suck the web W from the other surface of the second mesh belt 71. As a result, the web W is attracted to the second mesh belt 71. When the web W is transported by the second mesh belt 71, the web W does not peel off to fall from the second mesh belt 71.

As illustrated in FIG. 2, the humidifier 15 is disposed on a side of the one surface of the second mesh belt 71 in the web transport portion 13. That is, the humidifier 15 is positioned below the web transport portion 13. The humidifier 15 is positioned below the web transport portion 13 with the transport path of the web W interposed therebetween. The transport path of the web W is between the web transport portion 13 and the humidifier 15. A moisture meter 80 is disposed downstream of the humidifier 15 in the transport direction T. The humidifier 15 and the moisture meter 80 are disposed, below the second mesh belt 71, at positions facing the second mesh belt 71. The humidifier 15 and the moisture meter 80 are adjacent to each other in the transport direction T. The moisture meter 80 measures the moisture contained in the web W. The moisture meter 80 is communicably coupled to the controller 20 illustrated in FIG. 1. A measurement result by the moisture meter 80 is outputted to the controller 20.

As illustrated in FIG. 2, the humidifier 15 includes a case 91, a duct 92, a tank 93, a thermometer 94, a mist generation portion 95, and an air duct 97. The tank 93, the mist generation portion 95, and the air duct 97 are accommodated in the case 91. The duct 92 is provided on an upper part of the case 91. The duct 92 covers the case 91. The tank 93, the mist generation portion 95, and the air duct 97 are surrounded by the case 91 and the duct 92. The tank 93 can store water L. The thermometer 94 measures a temperature of the water L inside the tank 93. The thermometer 94 is communicably coupled to the controller 20 illustrated in FIG. 1. A measurement result of the temperature of the water L by the thermometer 94 is outputted to the controller 20.

As illustrated in FIG. 2, the mist generation portion 95 is disposed inside the tank 93. As the mist generation portion 95, for example, various devices such as an ultrasonic mist generator, a heating steam generator, and a vaporizing humidifier using air blow can be used. In the present embodiment, an ultrasonic mist generator having a piezoelectric vibrator is used as the mist generation portion 95. With the use of the ultrasonic mist generator having the piezoelectric vibrator, mist M is generated from the water L by generating ultrasonic waves in the water L. The generated mist M rises from the surface of the water L in the tank 93.

A suction port 97A is formed in the case 91. The suction port 97A communicates with the air duct 97. An exhaust port 97B is formed in the air duct 97. The exhaust port 97B opens toward the inside of the tank 93. An exhaust port 99 is formed in the duct 92. The exhaust port 99 opens toward the second mesh belt 71 of the web transport portion 13. The transport path of the web W passes between the exhaust port 99 and the web transport portion 13. That is, the exhaust port 99 is opened toward the web W transported by the web transport portion 13.

When the second suction mechanism 73 is operated, the air inside the duct 92 is sucked from the exhaust port 99 by the suction force of the suction fan 74. When the air inside the duct 92 is sucked from the exhaust port 99, the air pressure inside the duct 92 decreases. When the air pressure inside the duct 92 decreases, the air outside the humidifier 15 is sucked into the humidifier 15 through the suction port 97A. The air sucked into the humidifier 15 from the suction port 97A is exhausted from the exhaust port 97B toward the inside of the tank 93 through the air duct 97.

The air exhausted toward the inside of the tank 93 becomes airflow and flows toward the exhaust port 99 inside the duct 92. At this time, when the mist generation portion 95 is driven, the mist M generated from the water L inside the tank 93 is mixed with the airflow flowing inside the duct 92, and thus the humidified air MA is generated. The humidified air MA is blown onto the web W from the exhaust port 99 along with the airflow flowing inside the duct 92. Thus, the web W is appropriately humidified. In the present embodiment, since the humidifier 15 is positioned below the web transport portion 13, even when dew condensation occurs in the humidifier 15 or in the vicinity thereof, water droplets do not fall onto the web W.

The exhaust port 99 has a rectangular shape. A side of the exhaust port 99 in a direction intersecting with the transport direction T is longer than a width of the web W, and the humidified air MA can be exhausted to the entire width of the transported web W. The exhaust port 99 is covered with a mesh surface formed of a metal net made of aluminum or the like. The mesh surface of the exhaust port 99 allows the humidified air MA to pass through while preventing foreign matter such as fibers from entering into the exhaust port 99. Further, the humidifier 15 includes a tray 101. Foreign matter such as fibers, falling from the exhaust port 99 and entering into the humidifier 15, is received and captured by the tray 101.

The second suction mechanism 73 is disposed on a side of the other surface of the second mesh belt 71. The second suction mechanism 73 is disposed at a position facing the humidifier 15 with the second mesh belt 71 interposed therebetween. The suction port 75 of the second suction mechanism 73 and the exhaust port 99 of the humidifier 15 face each other with the second mesh belt 71 interposed therebetween. By driving the suction fan 74, the humidified air MA exhausted from the exhaust port 99 of the humidifier 15 is sucked through the suction duct 76. The humidified air MA exhausted from the exhaust port 99 is sucked through the suction duct 76 from the suction port 75 facing the exhaust port 99 with the second mesh belt 71 interposed therebetween. The humidified air MA passes through the web W in contact with the one surface of the second mesh belt 71. As a result, the web W is uniformly humidified by the humidified air MA.

Each of the plurality of suction ports 75 is formed in corresponding one of the suction ducts 76. Each of the plurality of suction fans 74 is provided for corresponding one of the suction ducts 76. The plurality of suction fans 74 can independently be driven. The second suction mechanism 73 can make the flow rate of the humidified air MA passing through the web W constant. This makes the amount of moisture applied to the web W being transported more uniform. As a result, it is easy to suppress variations in the strength of the sheet S, and thus it is possible to ensure the quality of the sheet S.

An air blower 150 is disposed downstream of the second suction mechanism 73 in the transport path of the web W. The air blower 150 is disposed at a position facing the web W with the second mesh belt 71 interposed therebetween. The air blower 150 is provided at a position adjacent to an exit-side roller 72A which is provided at a position closest to the sheet forming portion 17 among the plurality of rollers 72 in the web transport portion 13. The air blower 150 is disposed between a downstream end portion of the second suction mechanism 73 in the transport direction T and the exit-side roller 72A. The air blower 150 blows compressed air to the one surface WA of the web W through the second mesh belt 71. The air blower 150 efficiently peels off the web W from the second mesh belt 71 by blowing the compressed air toward the web W.

The air blower 150 includes a compression portion (not illustrated) to compress air and an opening 151 to exhaust the compressed air. An air compressor or the like is used as the compression portion to compress air, for example. The opening 151 is provided at a position adjacent to the exit-side roller 72A and facing the other surface of the second mesh belt 71. The opening 151 has an elongated rectangular shape. The opening 151 can blow compressed air over the entire width of the one surface WA of the web W in contact with the second mesh belt 71.

Because the web W is humidified by the humidifier 15, adhesion of the web W to the second mesh belt 71 increases, and the web W may stick to the second mesh belt 71. When the web W is not peeled off from the second mesh belt 71 only by gravity, the web W is not smoothly transported to the sheet forming portion 17, and a transport failure of the web W or damage to the web W may occur. To cope with the problem above, in the present embodiment, the air blower 150 blows the compressed air toward the web W, whereby the web W is blown downward. As a result, the web W is smoothly peeled off from the second mesh belt 71 and smoothly transferred to the sheet forming portion 17. Therefore, it is possible to prevent the transport failure of the web W and the damage to the web.

The moisture meter 80 is disposed downstream of the humidifier 15 in the transport path of the web W. The moisture meter 80 measures the moisture contained in the web W. The moisture meter 80 measures the moisture of the web W in no contact with the web W. As the moisture meter 80, for example, a moisture meter using infrared rays or microwaves can be used. In the present embodiment, an infrared moisture meter is used as the moisture meter 80. The moisture meter 80 can measure the moisture contained in the web W by irradiating infrared rays from the other surface WB of the web W and receiving returned infrared rays. The measurement result by the moisture meter 80 is outputted to the controller 20 illustrated in FIG. 1.

The controller 20 controls the moisture content of the web W, based on the moisture content of the web W acquired from the moisture meter 80. The control of the moisture content of the web W is a feedback-control. The moisture content of the web W is controlled by controlling the drive of the mist generation portion 95 of the humidifier 15. The generation amount of the mist M contained in the humidified air MA is controlled by the controller 20 by controlling the mist generation portion 95 of the humidifier 15. As a result, the moisture content of the web W can be controlled. The moisture content of the web W is preferably 12 mass % or more and 40 mass % or less. By controlling the moisture content of the web W within the range above, it is possible to effectively form hydrogen bonds between the fibrils of the fibers in the web W. As a result, the strength of the sheet S can be increased.

The generation amount of the mist M can be controlled by changing the strength of the drive of the mist generation portion 95. As described above, the ultrasonic mist generator having the piezoelectric vibrator is used as the mist generation portion 95. By changing the strength of the drive of the piezoelectric vibrator, the strength of the drive of the mist generation portion 95 can be changed. The drive of the piezoelectric vibrator of the mist generation portion 95 is controlled by a pulse width modulation (PWM) method. By increasing the pulse width of the voltage waveform for driving the piezoelectric vibrator, the drive of the piezoelectric vibrator can be strengthened. Conversely, the drive of the piezoelectric vibrator can be weakened by shortening the pulse width of the voltage waveform for driving the piezoelectric vibrator.

In the PWM control, increasing the pulse width of the drive voltage waveform is expressed as making a duty ratio larger. Similarly, shortening the pulse width of the drive voltage waveform is expressed as making the duty ratio smaller. By making the duty ratio of the drive voltage waveform larger, the drive of the mist generation portion 95 can be strengthened. By strengthening the drive of the mist generation portion 95, it is possible to increase the generation amount of the mist M. By making the duty ratio of the drive voltage waveform smaller, the drive of the mist generation portion 95 can be weakened. By weakening the drive of the mist generation portion 95, it is possible to reduce the generation amount of the mist M.

When the moisture of the web W can be measured by the moisture meter 80, the moisture content of the web W can be feedback-controlled. However, the moisture content of the web W cannot be feedback-controlled in a state before the web W reaches the moisture meter 80. Such a case may occur, for example, between a start of the formation of the web W and reaching of the leading end of the web W at the moisture meter 80. How to control the generation amount of the mist M in a state before the web W reaches the moisture meter 80 is a problem. Note that the reaching of the web W at the moisture meter 80 means that the web W reaches a position facing the moisture meter 80. The reaching of the web W at the moisture meter 80 means a state that the web W and the moisture meter 80 face each other. The state that the web W and the moisture meter 80 face each other is a state that the web W overlaps with the moisture meter 80 when the moisture meter 80 is viewed downward from vertically above.

In the present embodiment, in the state before the web W reaches the moisture meter 80, a method of controlling the drive of the humidifier 15, based on at least one of the measurement result by the thermometer 94 and the measurement result by the hygrometer 22, is adopted. The thermometer 94 measures the temperature of the water L. The hygrometer 22 measures the humidity of the environment in which the sheet manufacturing apparatus 1 is disposed. A mode in which the drive of the humidifier 15 is controlled based on at least one of the measurement result by the thermometer 94 and the measurement result by the hygrometer 22 is referred to as a first mode. A mode in which the drive of the humidifier 15 is controlled based on the measurement result by the moisture meter 80 after the first mode is referred to as a second mode.

In the present embodiment, when the web W reaches the moisture meter 80, the drive control of the humidifier 15 is switched from the first mode to the second mode. The switching from the first mode to the second mode is executed by the controller 20. Whether or not the web W has reached the moisture meter 80 is determined by the controller 20. That is, the control method of the sheet manufacturing apparatus 1 in the present embodiment includes switching from the first mode to the second mode, based on the determination that the leading end of the web W has reached the moisture meter 80.

The reaching of the web W at the moisture meter 80 can be detected by, for example, providing a sensor. A detection result by the sensor is transmitted to the controller 20. As the sensor to detect that the web W has reached the moisture meter 80, for example, an optical sensor such as a photosensor, an ultrasonic sensor, or the like can be used. The reaching of the web W at the moisture meter 80 can also be determined by counting the elapsed time from a start of the transport of the web W. The timing of switching from the first mode to the second mode is not limited to the aspect described above, and as another aspect, for example, a timing at which the web W has reached the sheet forming portion 17 may be used.

The control method of the sheet manufacturing apparatus 1 includes the first mode. The first mode is a mode in which the drive of the humidifier 15 is controlled based on at least one of the measurement result of the temperature of the water L by the thermometer 94 and the measurement result of the humidity by the hygrometer 22 until when the leading end of the web W reaches the moisture meter 80. According to the control method above, the moisture amount of the web W can be controlled until when the leading end of the web W reaches the moisture meter 80.

In the control method of the sheet manufacturing apparatus 1, for example, in the first mode, it is possible to control the drive of the humidifier 15, based on a function in which each of the measurement result by the thermometer 94 and the measurement result by the hygrometer 22 is a variable. As a function applicable to the first mode, for example, a function using the measurement result of the temperature of the water L by the thermometer 94 as a variable can be adopted. The function using the measurement result of the temperature of the water L by the thermometer 94 as a variable is referred to as a first function. As a function applicable to the first mode, for example, a function using the measurement result of the humidity by the hygrometer 22 as a variable can also be adopted. The function using the measurement result of the humidity by the hygrometer 22 as a variable is referred to as a second function.

Further, as a function applicable to the first mode, for example, a function using both of the measurement result of the temperature of the water L by the thermometer 94 and the measurement result of the humidity by the hygrometer 22 as variables can also be adopted. The function using both of the measurement result of the temperature of the water L by the thermometer 94 and the measurement result of the humidity by the hygrometer 22 as variables is referred to as a third function. The moisture amount of the web W can be controlled by any of the first function, the second function, and the third function until when the leading end of the web W reaches the moisture meter 80.

In the drive control of the humidifier 15 based on the measurement result of the temperature of the water L by the thermometer 94, the piezoelectric vibrator is driven at a duty ratio derived from the following formula (1). The formula (1) corresponds to the first function described above.

$$\text{Duty ratio } \% = (65 - (\text{water temperature} - 23) \times 2)/100 \qquad \text{Formula (1)}$$

The water temperature in the formula (1) is a measured value of the temperature of the water L by the thermometer 94, and the unit is ° C. When the calculation result is 100% or more, the duty ratio is set to 100%. When the calculation result is 20% or less, the duty ratio is set to 20%.

In the drive control of the humidifier 15 based on the measurement result of the humidity by the hygrometer 22, the piezoelectric vibrator is driven at a duty ratio derived from the following formula (2). The formula (2) corresponds to the second function described above.

$$\text{Duty ratio } \% = (65 - (\text{humidity} - 50) \times 1.6)/100 \qquad \text{Formula (2)}$$

The humidity in the formula (2) is a measured value of the relative humidity by the hygrometer 22, and the unit is % RH. When the calculation result is 100% or more, the duty ratio is set to 100%. When the calculation result is 20% or less, the duty ratio is set to 20%.

In the drive control of the humidifier 15 based on the measurement result of the temperature of the water L by the thermometer 94 and the measurement result of the humidity by the hygrometer 22, the piezoelectric vibrator is driven at a duty ratio derived from the following formula (3). The formula (3) corresponds to the third function described above.

Formula (3)

$$\text{Duty ratio } \% = (65 - (\text{water temperature} - 23) \times 1 - (\text{humidity} - 50) \times 0.8)/100$$

The water temperature in the formula (3) is a measured value of the temperature of the water L by the thermometer 94, and the unit is ° C. Further, the humidity in the formula (3) is a measured value of the relative humidity by the hygrometer 22, and the unit is % RH. When the calculation result is 100% or more, the duty ratio is set to 100%. When the calculation result is 20% or less, the duty ratio is set to 20%.

It is possible to control the moisture amount of the web W by controlling the drive waveform of the piezoelectric vibrator of the humidifier 15, based on any of the calculation formulae (1), (2), and (3). The formulae (1), (2), and (3) are stored in the memory of the controller 20. The controller 20 calculates the duty ratio by reading any of the formulae (1), (2), and (3) from the memory and then inputting the measured value by the thermometer 94 and/or the hygrometer 22. As described above, the drive of the humidifier 15 can be controlled based on at least one of the measurement result of the temperature of the water L by the thermometer 94 and the measurement result of the humidity by the hygrometer 22.

The method of deriving the duty ratio is not limited to the above-described function. The duty ratio can also be derived by, for example, tabulating the temperature of the water L, the humidity, and the duty ratio. A table for deriving the duty ratio is illustrated in FIG. 3. The duty ratio can be derived by collating the measurement result by the thermometer 94 and the measurement result by the hygrometer 22 with the table in FIG. 3. In the table in FIG. 3, a duty ratio is assigned for each of conditions 1 to 7. When collated with the table in FIG. 3, a combination of the measurement result by the thermometer 94 and the measurement result by the hygrometer 22 matches any of the conditions 1 to 7. The duty ratio can be derived from the matching condition.

For example, an example in which the temperature of the water L is 16° C. and the humidity is 30% RH satisfies the condition 3. Therefore, in this example, a duty ratio of 100% assigned for the condition 3 is derived. In an example in which all of the condition 1, the condition 3, and the condition 4 are satisfied, the condition 1 has the first priority. Further, in an example in which all of the condition 2, the condition 5, and the condition 6 are satisfied, the condition 2 has the first priority. The table in FIG. 3 is stored in the memory of the controller 20. The controller 20 collates the measured values by the thermometer 94 and the hygrometer 22 with the table in FIG. 3 to derive a duty ratio from the matching condition.

FIG. 3 exemplifies a table in which both of the measurement result of the temperature of the water L by the thermometer 94 and the measurement result of the humidity by the hygrometer 22 are used as variables. However, the variables of the table may be only the measurement result of the temperature of the water L by the thermometer 94. Further, the variables of the table may be only the measurement result of the humidity by the hygrometer 22. By creating a table suitable for each case, a duty ratio can appropriately be derived. As described above, the drive of the humidifier 15 can be controlled based on at least one of the measurement result of the temperature of the water L by the thermometer 94 and the measurement result of the humidity by the hygrometer 22.

In the present embodiment, the reaching of the web W at the moisture meter 80 is determined by counting the elapsed time from the start of the transport of the web W. As illustrated in FIG. 1, the defibrated material passing through the drum 51 is deposited on the first mesh belt 61. The first mesh belt 61 is an example of a deposition belt. In the sheet manufacturing apparatus 1, after the defibrated material starts to be deposited on the first mesh belt 61, the rotational drive of the first mesh belt 61 is started. The controller 20 counts the elapsed time from a start of the rotational drive of the first mesh belt 61.

The controller 20 starts the drive of the humidifier 15 in the first mode after a first period has elapsed from the start of the rotational drive of the first mesh belt 61. At this time, the first period is the time from the start of the rotational drive of the first mesh belt 61 until the leading end of the web W reaches the exhaust port 99 of the humidifier 15. That is, the controller 20 starts the drive of the humidifier 15 in the first mode, based on the determination that the leading end of the web W has reached the humidifier 15. Thus, it is possible to start the humidification of the web W at an appropriate timing, and it is easy to avoid applying humidity to the web transport portion 13 in a state that the web W has not reached.

After the first period has elapsed, and further after a second period has elapsed, the controller 20 switches from the first mode to the second mode. The second period is the time after the first period has elapsed until the leading end of the web W reaches the moisture meter 80. That is, the controller 20 switches from the first mode to the second mode after the first period and the second period have elapsed from the start of the rotational drive of the first mesh belt 61. Thus, over a predetermined length of the web W from the leading end thereof, the web W can be humidified in the first mode.

What is claimed is:

1. A method of controlling a sheet manufacturing apparatus that manufactures a sheet from a material containing fibers, the sheet manufacturing apparatus including a deposition portion that forms a web from the material by depositing the material, a transport portion that includes a transport belt which transports the web in a state that the web is supported, a humidifier that humidifies the web by discharging air mixed with water supplied from a tank which stores the water, a heating roller that is positioned downstream of the humidifier in a transport direction of the web and that heats the web to form the sheet from the web, a moisture meter that is positioned between the humidifier and the heating roller and that measures a moisture amount contained in the web, a thermometer that measures a temperature of the water stored in the tank, and a hygrometer that measures humidity outside the sheet manufacturing apparatus, the control method comprising:

controlling, as a first mode, drive of the humidifier, based on at least one of a measurement result of the temperature of the water by the thermometer and a measurement result of the humidity by the hygrometer until when a leading end of the web reaches the moisture meter; and controlling, as a second mode, the drive of the humidifier, based on a measurement result of the moisture amount by the moisture meter after execution of the first mode.

2. The method of controlling a sheet manufacturing apparatus according to claim 1, wherein in the first mode, the drive of the humidifier is controlled based on a function in which each of the measurement result of the temperature of the water by the thermometer and the measurement result of the humidity by the hygrometer is a variable.

3. The method of controlling a sheet manufacturing apparatus according to claim 1, further comprising switching from the first mode to the second mode, based on determination of the leading end of the web being reached the moisture meter.

4. The method of controlling a sheet manufacturing apparatus according to claim 1, wherein the deposition portion includes a deposition belt subjected to rotational drive while depositing the material, the drive of the humidifier in the first mode is started after a first period elapses from a start of the rotational drive of the deposition belt, and the first mode is switched to the second mode at a timing when a second period elapses after the first period elapses.

* * * * *